US005095293A

United States Patent [19]

Patel et al.

[11] Patent Number: 5,095,293

[45] Date of Patent: Mar. 10, 1992

[54] CIRCUIT BREAKER CONTACT WIPE INDICATOR

[75] Inventors: Nagar J. Patel, Plum Boro; Daniel D. Gress, Jr., Monroeville; Edward J. Klimek, Jeannette, all of Pa.

[73] Assignee: Westinghouse Electric Corp., Pittsburgh, Pa.

[21] Appl. No.: 621,109

[22] Filed: Nov. 30, 1990

[51] Int. Cl.[5] ..... H01H 73/12

[52] U.S. Cl. ..... 335/17; 335/20

[58] Field of Search ..... 335/6, 17, 20, 28, 172–176

[56] References Cited

U.S. PATENT DOCUMENTS 4,554,524 11/1985 Radus ..... 335/17
4,743,876 5/1988 Milianowicz et al. .
4,975,673 12/1990 Ikehata et al. ..... 335/17

*Primary Examiner*—Leo P. Picard
*Assistant Examiner*—Lincoln Donovan
*Attorney, Agent, or Firm*—M. J. Moran

[57] ABSTRACT

A visually inspectable indicator for a circuit breaker interrupter apparatus is provided. The visual indicator is located on a portion of the contact wipe assembly of an operating rod assembly of a circuit breaker to provide a reading of relative movement between components of the contact wipe assembly. This reading is related to integrity of the contacts. In a preferred embodiment, the indicator is a T-shaped cut out which is positioned and dimensioned such that it provides a reading relating to compression of the contact spring of the operating rod assembly when the assembly and the circuit breaker contacts are in the closed position which, in turn, provides an indication of the condition of the contacts.

25 Claims, 4 Drawing Sheets

CIRCUIT BREAKER CONTACT WIPE INDICATOR

BACKGROUND OF THE INVENTION

1. Field of the Invention

This invention relates to an apparatus for providing visual indicia of the safe operating range of the interrupter assembly of a circuit breaker interrupter apparatus.

2. Background Information and Description of the Prior Art

Circuit breakers provide protection for electrical systems from electrical fault conditions such as current overloads, short circuits, and low level voltage conditions. Typically, circuit breakers include a spring-powered operating mechanism which opens electrical contacts to interrupt the current through the conductors on an electrical system in response to abnormal conditions. In particular, vacuum circuit interrupter apparatus have been known which include separable main contacts disposed within an insulating housing. Generally, one of the contacts is fixed relative to both the housing and to an external electrical conductor which is interconnected with the circuit to be controlled by the circuit interrupter. The other contact is movable. In the case of a vacuum circuit interrupter, the movable contact assembly usually comprises a stem of circular cross section having the contact at one end thereof enclosed within the vacuum chamber and a driving mechanism at the other end which is external to the vacuum chamber. An operating rod assembly is provided which carries a rotatable contact bell crank which is slidable on the operating rod and rotates about a pivot pin upon motion of the operating rod. This plate is connected to the stem of the movable contact. Motion of the plate causes motion of the movable contact into or out of engagement with the fixed contact.

The operating rod assembly is operatively connected to a latchable operating mechanism which is responsive to current. When an abnormal condition is reached, the latchable operating mechanism becomes unlatched which causes the operating rod to move to the open position. The motion of the operating rod, in turn, causes the contact bell crank to rotate and, as discussed above, this controls motion of the movable contact.

Compression springs are provided in the operating rod assembly in order to be able to separate the movable contact from the fixed contact and to assure the necessary force so that the contacts will not accidentally open in inappropriate conditions. In addition, when appropriate circumstances requiring interruption of the circuit do arise, an adequate force is needed to open the contacts with sufficient speed. If the contacts do not open quickly, there is a risk of the contacts welding together and failure to interrupt the current.

If, on the other hand, a low level fault occurs, the current level is not high so the contacts would not weld, however, due to inadequate opening energy the breaker may open but it may continue to conduct.

In order to achieve the adequate interrupt speed and force, springs are mounted on the operating rod assembly. The springs are typically mounted towards one end of the operating rod on what is referred to as the contact wipe portion of the operating rod assembly. Contact wipe is a measure of the force required to hold the vacuum interrupter contacts closed and the energy to force the contacts open with sufficient speed for safe and clean interruption as discussed above. As noted above, the contact springs which comprise part of the contact wipe assembly must provide the force to hold the contacts closed and the energy to pry them open with appropriate speed. Therefore, if such springs are compression springs as is typically the case, it is important that the springs have sufficient compression during operation. On the other hand, if tension springs are utilized, adequate tension must exist.

In a typical case, the spring is held on the operating rod between a disk-shaped spacer member which is carried along the operating rod and a shoulder portion of a set of contact wipe plates which are mounted at one end of the operating rod and spaced apart from the spacer member. When the contacts are closed, the operating rod travels toward its closed position. The contact wipe plates are slidably mounted on the operating rod at the same point at which the rotatable contact bell crank is mounted. When the contacts seat, motion of the contact wipe plates stop. However, motion of the operating rod continues until it travels to its full extended position. At this point, the spring is fully compressed between the spacer member and the shoulder section of the contact wipe plates.

At present, there is not a known method of visually checking (without measurements) the spring compression (or tension) to determine whether it is adequate. Adequate spring compression is, in one respect, an indication of the contacts being in good condition. This is because contacts which are worn would require a greater degree of travel by the contact wipe plates which would mean that the compression of the spring between the shoulder portion of the contact wipe plates and the disk-shaped spacer would not be as great.

There is a need, therefore, for a convenient and easy to use inspection apparatus for use with the contact wipe springs with which the compression of the springs may be visually inspected. This would serve as an indication of correct contact force and indirectly provides an indication of the integrity of the contacts. There is a preferred need for such a device which does not require additional measuring apparatus and does not require disassembly of the circuit breaker or any portion of it.

SUMMARY OF THE INVENTION

These and other needs are satisfied by the present invention which comprises a contact wipe indicator for a vacuum circuit breaker. The circuit breaker includes an operating rod assembly which operates to separate the contacts, as discussed in further detail herein, when an associated latchable operating mechanism is activated in response to an abnormal or undesirable condition. The operating rod assembly has a pair of contact wipe plates slidably mounted adjacent one end thereof. The operating rod assembly includes an operating rod extension tongue which is received between the contact wipe plates. In addition, in one embodiment, a set of internal tab members may be mounted between the contact wipe plate and the extension tongue. In accordance with the invention, a visual indicia of relative motion between the contact wipe plate and the extension tongue of the operating rod is provided. When the operating rod assembly is in a closed position, the indicia will provide a reading of adequacy of spring compression which in turn, additionally, indirectly relates to the integrity of the contacts of the breaker.

More particularly, in one embodiment, a T-shaped cutout may be positioned on the contact wipe plate such that the extension tongue of the operating rod in the closed position is visible underneath the T-shaped cutout. This provides a visual reading of relative movement between the contact wipe plate and the extension tongue. If the operating rod is visible along the entirety of the T-shape, this indicates an adequate compression range when the breaker is assembled at the factory. If at least a portion of the extension tongue is visible along the length of the T-shaped cutout, then this indicates a satisfactory switching range for the interrupter apparatus while in use by the end user. If, on the other hand, the extension rod is not visible at all adjacent the T-shaped opening when the operating rod assembly is in the closed position, then this indicates an out-of-tolerance condition which means that replacement of the interrupter apparatus is required.

In accordance with another embodiment of the invention, a T-shaped cutout is placed on an internal tab member positioned between the contact wipe plates. The internal tab member in a closed position extends beyond the contact wipe plates. In accordance with this aspect of the invention, the internal tab member extends beyond the contact wipe plates to an amount such that the base of the indicia is visible, then this indicates appropriate factory assembly settings. If, during operation, a visual check indicates that any portion of the T-shaped cutout is visible, then this indicates a satisfactory switching range for the interrupter assembly. However, if a visual check shows that no portion of the T-shaped cutout on the internal tab member is visible beyond the contact wipe plate, then this indicates an out-of-tolerance condition and requires replacement of the interrupter assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
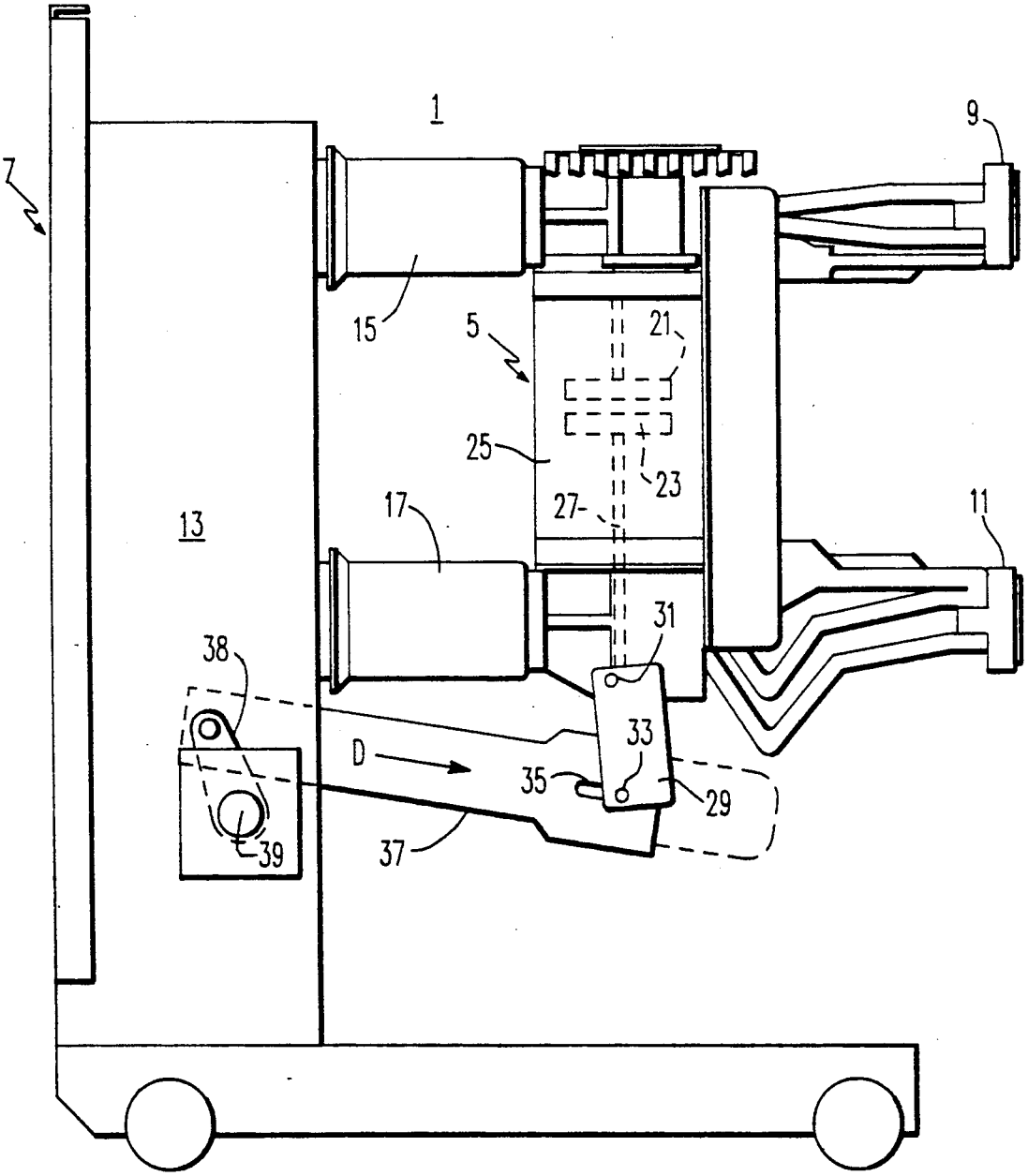
FIG. 1 is a schematic side elevation of a circuit breaker having a vacuum interrupter assembly.

Referring to FIG. 1, there is illustrated a circuit breaker 1 incorporating a vacuum interrupt apparatus 5. The circuit breaker 1 is preferably a drawout 3-phase vacuum circuit interrupter which has controls on the front panel 7 for manually operating the circuit breaker. The circuit breaker 1 also has terminals 9 and 11 for one phase of the breaker and it has additional terminals not visible in FIG. 1 which correspond to the other two phases. The terminals such as 9 and 11 are for contacting corresponding terminals in an associated system (not shown).

The circuit breaker 1 has a front low voltage portion 13 adjacent to the front panel 7 and a rear high voltage portion including vacuum circuit interrupter 5. The high and low voltage portions are electrically insulated from one another by upper and lower insulators 15 and 17, respectively. Vacuum interrupter 5 encloses a pair of separable contacts, including stationary contact 21 and movable contact 23 within a vacuum housing 25.

Details about the operating mechanism for moving the contacts 21 and 23 between an opened and closed position are described in detail in U.S. Pat. No. 4,743,876, which is owned by the assignee of the present application. U.S. Pat. No. 4,743,876 is herein incorporated by reference in its entirety. Briefly, vacuum interrupter moving stem 27 is suitably connected to a rotatable contact bell crank 29. Contact bell crank 29 is pivotally mounted at upper pin 31. It is also rotatably mounted at lower pin 33. Pin 33 is slidably fastened in slot 35 of operating rod 37.

Operating rod 37 moves in response to the rotation of lever arm 38 about operating shaft 39. This motion occurs when a latchable operating mechanism (not shown in FIG. 1), discussed more fully hereinbelow, is activated in response to an abnormal condition. When the operating rod 37 is placed in a closed position, operating rod 37 moves generally horizontally in the direction D. Pin 33 slides in slot 35 also in a generally horizontal direction. Bell crank 29 rotates in an arc-shaped path and the vertical component of this arc-shaped motion acts to lift vacuum interrupter moving stem 27 which moves movable contact 23 until it seats against fixed contact 21.

Figure 2:
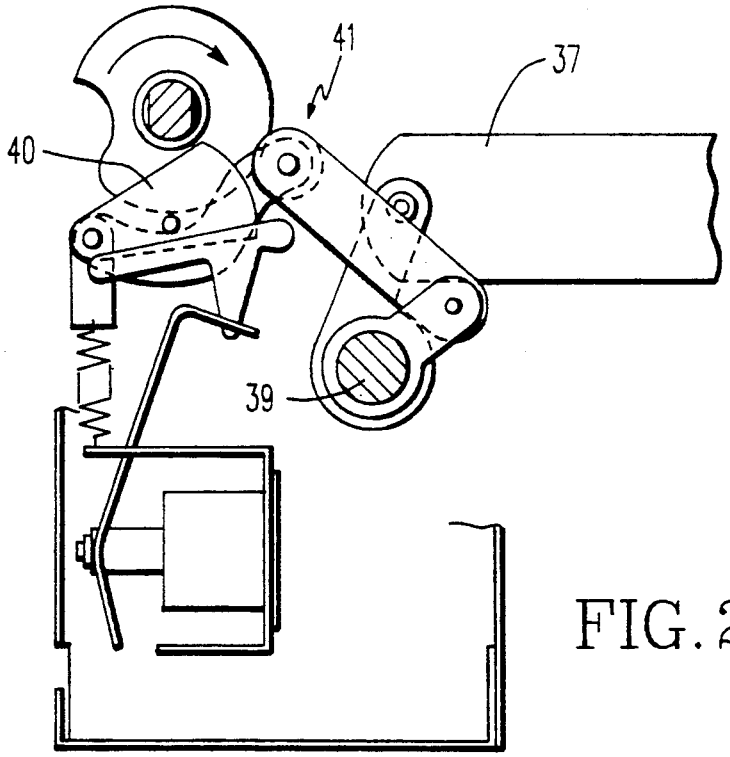
FIG. 2 is a schematic side illustration of the trip latch mechanism of a circuit breaker in the closed position.
Figure 3:
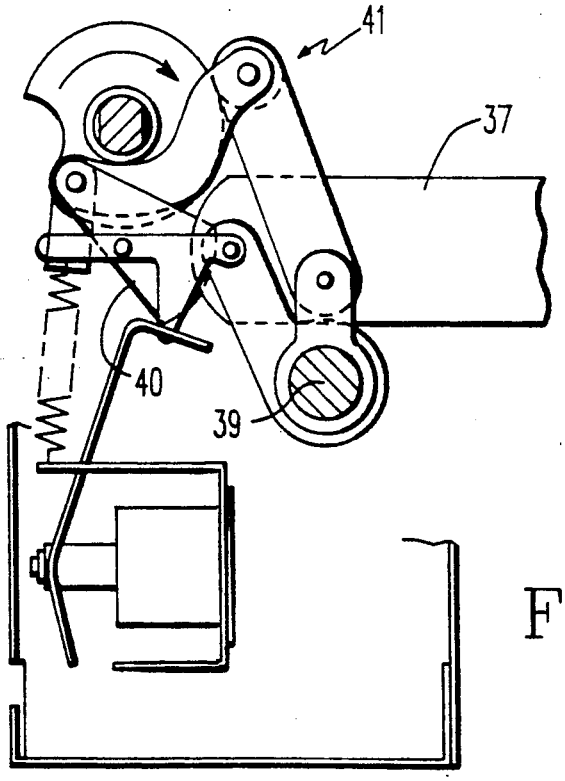
FIG. 3 is a schematic side illustration of the circuit breaker of FIG. 2 in the open position.

With reference to FIGS. 2 and 3, the operating linkage for opening the contacts 21, 23 will be briefly described. A trip latch 40 has a series of links collectively numbered 41 connected to it which are pivotally mounted with respect to operating shaft 39 and operating rod 37 such that when trip latch 40 falls from an initially upright position, as shown in FIG. 2, to the position shown in FIG. 3, operating rod 37 recedes back towards trip latch 40 and the breaker is then opened and contact 23 is separated from contact 21 (FIG. 1).

Figure 5:
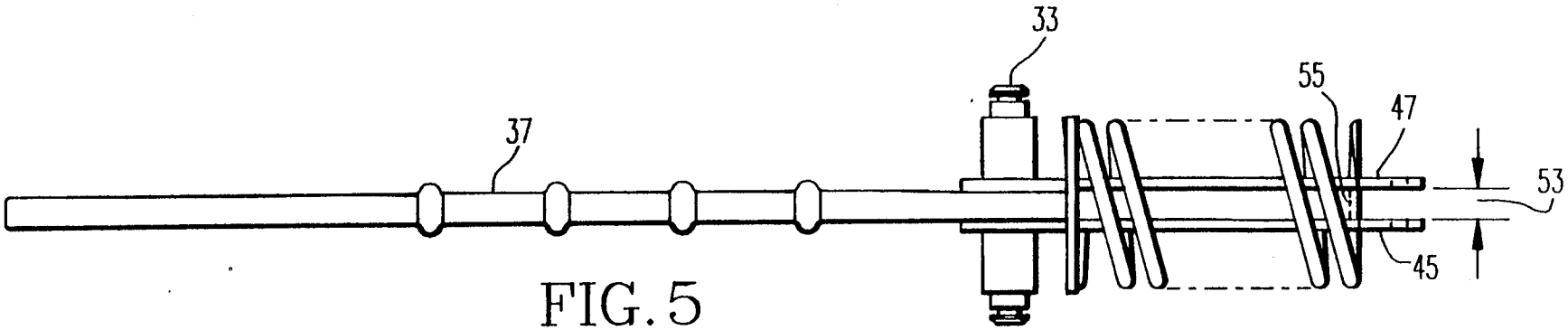
FIG. 5 is a top plan view of the device of FIG. 4.
Figure 4:
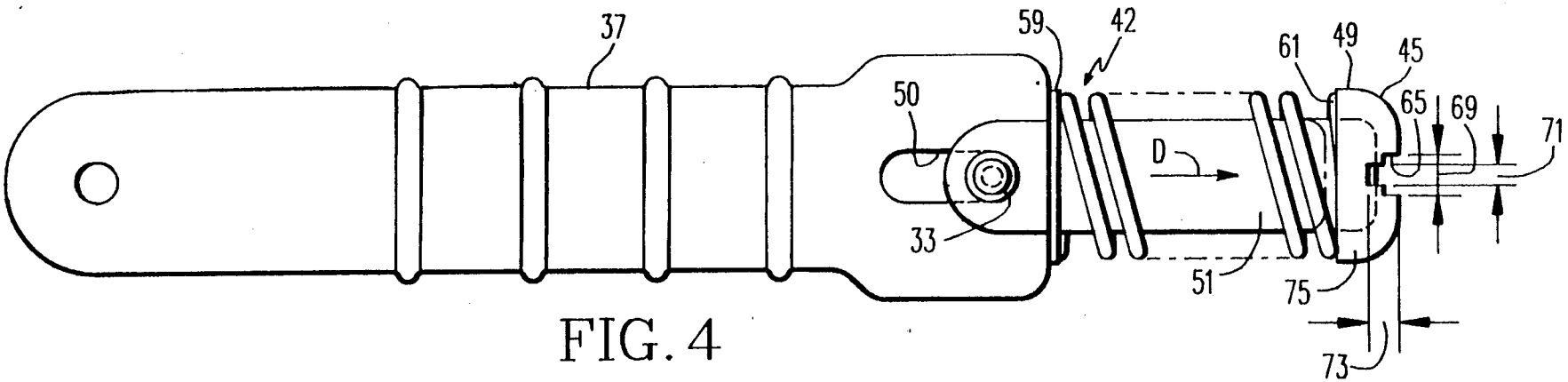
FIG. 4 is a side elevation of one embodiment of the operating rod assembly of the present invention.

When the circuit breaker is in the closed position, trip latch 40 retains operating rod 37 in the closed position. The additional force required to maintain the contacts in a closed position is provided by a spring which is typically a compression spring. Referring to FIG. 4, spring 42 is associated with operating rod 37. In the preferred embodiment, the spring 42 is held in compression while the breaker is in the closed position. More specifically, spring 42 is mounted upon a pair of contact wipe plates 45 and 47 (FIG. 5). Contact wipe plates 45 and 47 are carried on operating rod 37 generally adjacent one end thereof. Contact wipe plates 45 and 47 are connected to operating rod 37 at pin 33. Contact wipe plates 45 and 47 are slidable in that pin 33 moves within slot 50 when the operating rod 37 moves to the closed position.

As shown in FIG. 4, plate 45 has an enlarged head portion 49 and a more narrow internal body portion 51. Plates 45 and 47 are mounted parallel to one another defining a gap 53 therebetween. Operating rod 37 has extension tongue 55 which is received and slidable within the gap 53. When the breaker is closed, operating rod 37 moves in the direction D. When operating rod 37 moves in direction D, the extension tongue 55 also proceeds in direction D. Plates 45 and 47 also initially move in direction D to rotate bell crank 29 until the contacts 21, 23 seat. However, the operating rod 37 and extension tongue 55 continue to travel in direction D until operating rod 37 reaches its fully extended position. As noted hereinbefore, spring 42 is placed around plates 45 and 47. At one end, spring 42 rests against shoulder 61 of head portion 49 of plate 45 and a corresponding shoulder (not shown) in plate 47. At its opposite end, spring 42 rests against spacer 59 which is fixed to rod 37. When the breaker is moving towards the closed position, spring 42 is compressed between shoulders such as shoulder 61 and the spacer 59 after the contacts 21, 23 close and further movement of the plates 45 and 47 is arrested.

During abnormal operating conditions, the trip latch 40 (FIG. 2) and operating shaft 39 rotate thus causing the entire operating rod 37 to move in the direction opposite to direction D carrying with it the fixed plate 59. This relieves the compression force applied to spring 42 which expands to rotate bell crank 29 to open the contacts and as pin 33 reaches the end of slot 35 the plates 45 and 47 are carried along with the rod 37.

In accordance with one embodiment of the present invention which is shown in FIG. 4, an indicia such as T-shaped cutout 65 is provided in the head portion 49 on plate 45. The T-shaped cutout 65 is dimensioned such that the extension tongue 55 of operating rod 37 when it appears behind T-shaped cutout 65 gives an indication of relative movement between extension tongue 55 and the contact wipe plate 45. This provides an indirect reading of contact integrity. For example, if contacts 21 and 23 are worn, a farther distance of travel is required before the contacts 21, 23 seat against one another. This would result in the rod 37 reaching its full travel before there would be any appreciable compression in spring 42.

T-shaped cutout 65 is preferably about 12.7 millimeters in the base dimension designated by reference character 69 and a narrower width of about 6.3 millimeters in the dimension designated by reference character 71, and its dimension along the stem which extends longitudinally along contact wipe plate 45 and which is designated by reference character 73 is preferably about 10.4 millimeters. These dimensions are selected so that the extension tongue 55 of operating rod 37 will appear along the entirety of T-shaped cutout 65 if the spring is correctly compressed when the device leaves the factory. During operation, a correct operating range for compression of spring 42 will be indicated if any portion of extension tongue 55 of operating rod 37 is visible through T-shaped cutout 65. These readings are to be taken when the circuit breaker 1 is in the closed position, which is when the spring is compressed. An example of a closed position which gives a safe operating range reading is shown in the position indicated in FIG. 4 by the dashed lines 75. This is an example of operating rod 37 in a closed position and in which extension tongue 55 is visible through cutout 65 which means that compression of the spring 42 is in the safe operating range. If no portion of extension tongue 55 of operating rod 37 is visible within T-shaped cutout 65, then spring compression and thereby contact integrity is inadequate and replacement of the interrupter assembly would be required.

Figure 7:
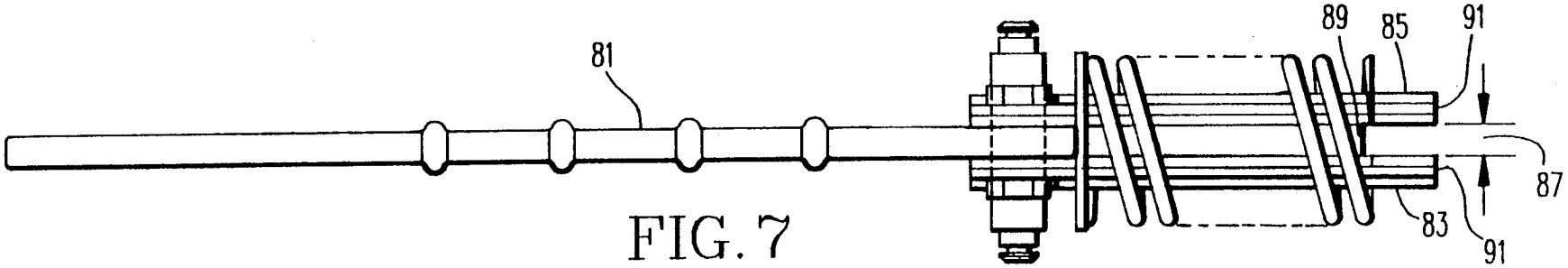
FIG. 7 is a top plan view of the device of FIG. 6.
Figure 6:
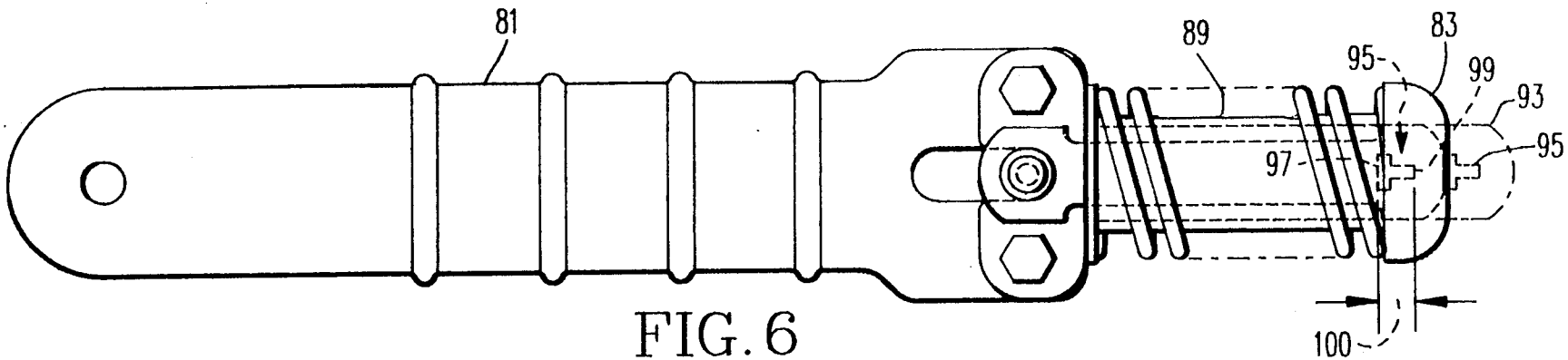
FIG. 6 is a side elevation of another embodiment of the operating rod assembly of the present invention.

An alternative embodiment of the invention is shown in FIGS. 6 and 7. In FIGS. 6 and 7, operating rod 81 has contact wipe plates 83 and 85 generally adjacent one end thereof. Contact wipe plates 83 and 85 are mounted parallel to one another defining gap 87 therebetween (FIG. 7). Also disposed within gap 87 are slidable tab members 91. Slidable tab members 91 are portions of the device which extend beyond contact wipe plate 83 when the breaker is in the closed position such as shown in phantom and designed by reference character 93. Extension tongue 89 of operating rod 81 is received within gap 87 in a manner similar to that described with reference to the embodiment shown in FIGS. 4 and 5. Other than the presence of the slidable tab members, the assembly of the embodiment of FIG. 6 operates in the same manner as that of FIGS. 4 and 5. However, as slidable tab members 91 are present in this embodiment of the operating rod assembly, then the T-shaped cutout could not be placed on contact wipe plate 83 because the internal tab 91 would obscure the extension tongue 89. Therefore, cutout 95 is placed on slidable tab member 91 as shown in FIG. 6. T-shaped cutout 95 provides an indication of relative movement between contact wipe plate 83 and tab member 91 which in turn is related to movement of the contacts and thereby is an indication of wear of the contacts 21, 23. In this embodiment, the T-shaped cutout would have dimensions as follows: along the base which is the greater width designed by reference character 97, the T-shaped cutout would be about 12.7 millimeters, along the narrower width 99, the T-shaped cutout would be about 6.3 millimeters, along its stem, the longitudal length 100 is preferably about 10.4 millimeters.

In operation, in accordance with this embodiment of the invention, the appropriate assembly tolerance setting for spring compression would occur when the entire T-shaped cutout 95 is visible beyond plate 83 in the closed position. This position is designed by reference character 93. In use, a safe operating range for the interrupter assembly is indicated when any portion of cutout 95 is visible beyond contact wipe plate 83. If however, no portion of cutout 95 is visible then this indicates an unsatisfactory condition and the interrupter assembly should be replaced.

It should be understood that the indicia of relative movement between the extension tongue of the operating rod and the contact wipe plates can take many different forms other than the T-shaped cutout described herein. For example, in the embodiment of FIG. 4, a positive member may be added as a build up to the extension tongue 55 instead of the cutout in the contact wipe plates 45, 47. These other visual indicators may be used while still remaining within the scope of the present invention.

It should also be appreciated that a convenient, easy to use indicator of the satisfactory range of operating conditions for an interrupter assembly is provided by the present invention. The indicator does not require additional measuring apparatus nor does it require disassembly of the device. A simple visual check is all that is required. In this way, the safe operating range is known. This apparatus can easily be retrofitted to existing vacuum circuit breakers.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An operating rod assembly for a vacuum contact interrupter in a circuit breaker having a latchable operating mechanism activated in response to an abnormal condition, and a set of electrical contacts having one contact being movable and the other contact being fixed, comprising:

operating rod means having one end operatively mounted with respect to said latchable operating mechanism such that said operating rod means moves to a first position from a second position in response to activation of said latchable operating mechanism;

contact wipe plate means slidably mounted generally adjacent said opposite end of said operating rod means such that said contact wipe plate means moves with said operating rod means towards said second position, and the motion of said contact wipe plate means being arrested when said contacts seat while said operating rod continues to move until said second position is reached;

contact separator means operatively mounted on said contact wipe plate means for translating the sliding movement of said contact wipe plate means into motion of said movable contact;

spring means disposed between said plate means and said operating rod means to apply a contact closure force to said movable contact after said contacts seat and said operating rod continues to move toward said second position; and visual indicia means operatively associated with said operating rod assembly for providing an indicia of relative movement between said contact wipe plate means and said operating rod means after said contacts seat.

2. The operating rod assembly of claim 1 wherein said visual indicia means is disposed on said contact wipe plate means such that said operating rod means is visible behind said contact wipe plate means when a satisfactory condition exists.

3. The operating rod assembly of claim 2 wherein said contact wipe plate means comprises two elongated and opposed metal plates, said plates being mounted parallel to one another defining a gap therebetween into which said operating rod means projects.

4. The operating rod assembly of claim 3 wherein: said visual indicia means is disposed on at least one contact wipe plate and said visual indicia means being a T-shaped cutout in said plate having a stem extending longitudinally along said plate and a base being normal to said stem such that said gap is visible adjacent said at least one contact wipe plate.

5. The operating rod assembly of claim 4 wherein said T-shaped cutout is of a dimension such that said operating rod means in said second position being visible within said gap adjacent said T-shaped cutout substantially entirely along said T-shaped cutout indicating a correct assembly tolerance setting, and at least a portion of said operating rod means being visible adjacent along any portion of said T-shaped cutout being visible indicates a satisfactory switching range, and no portion of said operating rod means being visible adjacent said T-shaped cutout indicating an unsatisfactory condition.

6. The operating rod assembly of claim 5 wherein said plates of said contact wipe plate means each have a body portion mounted generally adjacent to said opposite end of said operating rod means and an enlarged head portion disposed at another end of said plate, said head portion having said T-shaped cutout therein, and a shoulder being defined between said head portion and said body portion.

7. The operating rod assembly of claim 6 wherein said operating rod means also has a spacer disk mounted thereon and an extension tongue mounted thereon which projects through said spacer disk and said spring means is mounted between said spacer disk and said shoulders of said contact wipe plates.

8. The operating rod assembly of claim 7 wherein said spring means is a compression spring which is compressed between said spacer disk and said shoulder portions of said plates and said contact closure force is applied by said compression spring urging against said spacer disk when said operation rod means moves towards said second position after said contacts seat together.

9. The operating rod assembly of claim 8 wherein said extension tongue is visible in said T-shaped cut out when said spring means is fully compressed if said satisfactory condition exists.

10. The operating rod means of claim 7 wherein said spring means is a tension spring operatively disposed on said operating rod means, and said operating rod means also having biasing means thereon to which said tension spring is connected such that said contact closure force is provided by said tension spring.

11. The operating rod assembly of claim 3 further comprising:

internal tab means comprising two elongated tab members mounted generally adjacent said contact wipe plate means within said gap between said plates of said contact wipe plate means, said internal tab members being generally parallel to one another and spaced apart such that said operating rod means is received between said tab members.

12. The operating rod assembly of claim 11 wherein said internal tab members move with said operating rod means relative to said contact wipe plate means when said operating rod means moves to said second position, and in said second position said internal tab members extend beyond said contact wipe plate means.

13. The operating rod assembly of claim 12 wherein said visual indicia means is disposed on said internal tab means.

14. The operating rod assembly of claim 13 wherein said visual indicia means is disposed on at least one internal tab member and said visual indicia is visible beyond said contact wipe plate means when a satisfactory condition exists.

15. The operating rod assembly of claim 14 wherein said visual indicia means is a T-shaped cutout in said at least one internal tab member, said T-shaped cut out having a stem extending longitudinally along said internal tab member and a base of said T-shaped cutout being normal to said stem.

16. The operating rod assembly of claim 15 wherein said T-shaped cutout is positioned on said tab member such that the entire said T-shaped cutout being visible beyond said contact wipe plate means when said operating rod means is in said second position indicates a correct assembly tolerance setting, and at least a portion of said extension tongue of said operating rod means being visible along any portion of said T-shaped cutout being visible indicates a satisfactory switching range, and no portion of said extension tongue of said operating rod means being visible adjacent said T-shaped cutout indicating an unsatisfactory condition.

17. The operating rod assembly of claim 3 wherein said contact separator means is comprised of bell crank means slidably mounted on said operating rod means and pivotally connected to said movable contact such that when said operating rod means moves in response to said latchable operating mechanism, said bell crank means slides along said operating rod and pivotally rotates to move said movable contact.

18. The operating rod assembly of claim 17 wherein said operating rod means has a slot therein and said bell crank means and said contact wipe plates are both mounted on a pin disposed in said slot such that sliding motion of said contact wipe plate means occurs simultaneously with sliding and rotating motion of said bell crank means upon motion of said operating rod means.

19. A circuit breaker for interrupting current when the current level is of a predetermined value, comprising:

a pair of separable contacts at least one of which is movable between an open position and a closed position;

a circuit breaker operating mechanism including an operating shaft rotatable between open and closed position of said contacts;

trip latch means for releasably latching said operating mechanism;

linkage means comprising operating rod means operatively mounted with respect to said trip latch means such that said operating rod means is caused to move to a first position from a second position upon activation of said operating mechanism, and said operating rod means having an extension tongue projecting from one end thereof and a contact wipe means being mounted generally adjacent said operating rod means such that when said trip latch means is released said contact wipe means moves towards said second position until said contacts seat and said extension tongue of said operating rod means continues to move until said operating rod means reaches said second position, and said linkage means also having a visual indicia means having an indicator position, said indicia means in said indicator position providing a visible reading of relative movement between said extension tongue and said contact wipe plate means to indicate a predetermined condition of said contacts; and current responsive means for retaining said linkage in a contact-closed position as long as said current level remains within a predetermined range.

20. The circuit breaker of claim 19 wherein said contact wipe plate means comprises two elongated and opposed metal plates, each said metal plate having a body portion mounted at one end generally adjacent to said operating rod means and an enlarged head portion defining a shoulder between said head portion and said body portion, said plates being mounted parallel to one another defining a gap therebetween into which said extension tongue of said operating rod means is received.

21. The circuit breaker of claim 20 wherein said visual indicia means comprises at least one of said plates of said contact wipe plate means having a T-shaped cut-out portion in said head portion of said plate, said T-shaped cutout having a base of said T disposed generally adjacent one end of said head portion and a stem of said T-shaped cutout being normal to said base and extending generally towards said body portion of that plate.

22. The circuit breaker of claim 21 wherein said T-shaped cutout in said plate is of a dimension such that said extension tongue of said operating rod means in said second position being visible adjacent said T-shaped cutout indicates a correct assembly tolerance setting, and at least a portion of said extension tongue of said operating rod means in said second position being visible adjacent said T-shaped cutout indicates a satisfactory operating range, and no portion of said extension tongue of said operating rod means being visible adjacent said T-shaped cutout indicates an out-of-tolerance condition.

23. The circuit breaker of claim 19 further comprising:

internal tab means comprising at least two internal tab members mounted generally adjacent said plate means parallel to one another and positioned in said gap between said plate means in slidable relationship with respect to said plate means such that said internal tab member extends beyond said plate means when said operating rod means is in said second position.

24. The circuit breaker of claim 23 wherein said visual indicia means comprises at least one of said tab members of said internal tab means having a T-shaped cutout portion disposed therein generally adjacent said end of said internal tab member, said T-shaped cutout having a stem of said T-shape extending towards said end and a base of said T-shape normal to said stem.

25. The circuit breaker of claim 24 wherein said T-shaped cutout in said tab member is of a dimension such that the entirety of said T-shaped cutout being visible beyond said contact wipe plate means when said operating rod means is in said second position being indicative of a correct assembly tolerance setting, and at least a portion of said T-shaped cut out in said tab member being visible when said operating rod means in said second position being indicative of a correct operating range, and no portion of said T-shape cut out in said internal tab member being visible indicating an out-of-tolerance condition.

* * * * *